United States Patent [19]

Lister

[11] Patent Number: 4,911,250

[45] Date of Patent: Mar. 27, 1990

[54] PNEUMATIC PERCUSSION HAMMER

[76] Inventor: William Lister, 36 Rabaul Street, Moorooka, Queensland, 4105, Australia

[21] Appl. No.: 344,281

[22] PCT Filed: Oct. 26, 1987

[86] PCT No.: PCT/AU87/00362

§ 371 Date: Apr. 24, 1989

§ 102(e) Date: Apr. 24, 1989

[87] PCT Pub. No.: WO88/03220

PCT Pub. Date: May 19, 1988

[30] Foreign Application Priority Data

Oct. 24, 1986 [AU] Australia ..... 8685

[51] Int. Cl.[4] ..... B23Q 5/00

[52] U.S. Cl. ..... 173/17; 173/136; 173/73

[58] Field of Search ..... 173/13, 17, 73, 80, 173/134, 135, 136

[56] References Cited

U.S. PATENT DOCUMENTS

| | | | |
|---|---|---|---|
| 3,524,511 | 8/1970 | Klemm . | |
| 3,527,239 | 9/1970 | Boom | 173/17 X |
| 3,599,730 | 8/1971 | Luthman et al. | 173/17 X |
| 4,321,974 | 3/1982 | Klemm . | |
| 4,446,929 | 5/1984 | Pillow | 173/17 |
| 4,753,302 | 6/1988 | Gien et al. | 173/17 X |
| 4,790,390 | 12/1988 | Sweeny | 173/17 |

FOREIGN PATENT DOCUMENTS

| | | |
|---|---|---|
| 70572/74 | 1/1976 | Australia . |
| 52436/86 | 7/1987 | Australia . |
| 0204243 | 12/1986 | European Pat. Off. . |
| 85/04212 | 9/1985 | World Int. Prop. O. . |

*Primary Examiner*—Frank T. Yost
*Assistant Examiner*—Willmon Fridie, Jr.
*Attorney, Agent, or Firm*—Foley & Lardner, Schwartz, Jeffery, Schwaab, Mack, Blumenthal & Evans

[57] ABSTRACT

A pneumatic percussion hammer casing (10), a top sub (23) connected to the outer tube of a double tube drill stem, an air feed pipe (19) extending from the top sub (23) co-axially into the casing and co-axially about an air outflow pipe (21) connected at its upper end to the inner drill stem tube, its lower end slidable in an air passage (38) through bit (31) the shank of which (32) is slidable in a driver sub (33) at the lower casing end and topped by an anvil (35), a passage (43) having ducts (39,44) extending to the exterior of the bit (31). A tubular piston (27), slidable in the casing (10) co-axially about the air outflow pipe (21) engages, when brought down onto the anvil (35), tube (37) rising from passage (38) through the bit, shank and anvil. Annular chambers (11, 12, 13) are formed within the casing (10) and the axial passage of the piston is divided into upper and lower passages (29,30). Piston (27) is formed with ports (45, 46, 47, 48) to act as a valve for effecting reciprocating movement, impacting the anvil (35) on its downstrokes, but if the casing (10) is raised to lift the bit (31) from its work face, the anvil (35) and piston (27) descent so that the hammer is in a state of balance and automatically ceases operation.

3 Claims, 1 Drawing Sheet

PNEUMATIC PERCUSSION HAMMER

BACKGROUND OF THE INVENTION (1) Field of the Invention

THIS INVENTION relates to a pneumatic percussion hammer.

(2) Prior Art

Pneumatic percussion hammers are well-known and widely used in rock drilling, such a hammer being described and illustrated in the specification of my Australian Patent No. 493847. Although hammers according to this Patent have been found to be very efficient in operation, they are not able to provide uncontaminated core samples as the rock fragments carried by the flow of air up the bore hold, outside the hammer and the drill tube onto which the hammer is screwed, will be likely to detach fragments from the sides of the bore hole and the air flow will carry these as well as fragments from the bottom of the hole.

SUMMARY OF THE PRESENT INVENTION

The general object of the present invention is to provide a pneumatic percussion hammer which will overcome this disadvantage.

The invention resides broadly in a pneumatic percussion hammer for rock drilling including:

a tubular casing;

a top sub at the top of the casing for connection to, and to receive air under pressure from, the outer tube of a double tube drill stem;

an air feed pipe from the top sub extending co-axially into the casing an air outflow pipe for connection at the top to the inner tube of the drill stem and passing co-axially through the air feed pipe;

a bit, its shank mounted for limited slidable movement in the lower end of the casing;

an anvil on the bit shank;

a bit air passage through the anvil, shank and bit, and ducted to the exterior of the bit, the lower end of the air outflow pipe being slidably engaged in the lower part of this passage and communicating, through ducts, to the bottom of the bit;

a sliding seal tube, its lower end secured in the upper part of the bit air passage, and extending above the anvil and co-axially about the air outflow pipe;

a piston disposed co-axially about the air outflow tube and slidable in the casing to strike the anvil on its downstroke, the bore of the piston being restricted at an intermediate position for close slidable engagement with the air outflow tube and to divide the axial passage of the piston into an upper axial passage which is slidably engaged with the air feed tube and a lower axial passage for sliable engagement, when the piston is on its downstroke, with the sliding seal tube;

a top pressure chamber in the casing about and above the top of the piston;

a bottom pressure chamber in the casing about and below the piston;

a central chamber in the casing about an intermediate part of the piston; and pressure ports in the piston for directing air under pressure from the upper axial passage of the piston to the top pressure chamber when the piston is in raised position, and to the bottom pressure chamber when the piston is in lowered position, and exhaust ports in the piston for conducting air, when the piston is lowered, from the central chamber to the top pressure chamber.

Other features of the invention will become apparent from the following description.

BRIEF DESCRIPTION OF THE DRAWINGS

In order that a preferred embodiment of the invention may be readily understood and carried into practical effect, reference, is now made to the accompanying drawings wherein.

DETAILED DESCRIPTION OF THE PREFERRED EMBODIMENT

Figure 1:
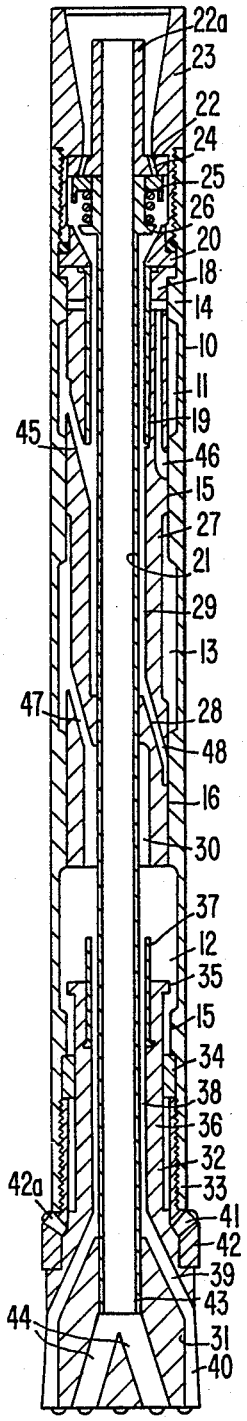
FIG. 1 is a sectional view of a percussion hammer according to the invention, its piston in fully raised position.

This percussion hammer includes a cylindrical tubular casing 10, of which each end part of the bore is enlarged and threaded. Two further enlargements of the bore define a top pressure chamber 11 and a bottom pressure chamber 12, and a central bore enlargement defines a central chamber 13. The lesser diameter parts between these chambers define a top shoulder 14, a bottom shoulder 15 and top and bottom piston bearings 16 and 17.

A piston stop ring 18 engaged with the top shoulder 14 has a seating for the enlarged top of air feed tube 19 co-axial with the casing 10 and held in place by a retaining ring 20. This retaining ring 20 is formed with a seating for the enlarged top of an air outflow tub 21 passing co-axially through, and spaced from, the air feed tube 19. An air inlet fitting 22 bears on the enlarged top of the air outflow tube 21, and is itself held in place by a top sub 23 screwed into the threaded upper end of the casing 10. The top sub may be engaged with a double-tube drill stem (not shown) of a rock drilling assembly, the central air outflow tube (not shown) of a rock drilling assembly, the central air outflow tube (not shown) of the drill stem being connected to the central tubular part **22*a* of the air inlet fitting 22. Air passing under pressure down through the outer tube of the drill stem may pass through air passages 24 in the base of the air inlet fitting 22, against the action of a spring-loaded check vavle 25, and by way of air passages 26 through the retaining ring 20 into the top of the air feed tube 19**.

A piston 27 is slidable in the top and bottom piston bearings 16 and 17 and is axially bored, an annular shoulder 28 within the bore, and which fits closely to the air outflow tube 21, dividing the piston bore into an upper axial passage 29 and a lower axial passage 30. The top part of the upper axial passage 29 is enlarged in diameter to receive closely but slidably the air feed tube 19.

A bit 31 has its shank 32 slidably engaged in a driver sub 33 screwed into the threaded lower end of the casing 10 to hold a split anvil stop ring 34 against the bottom shoulder 15, this stop ring limiting the downward movement of the enlarged upper end or anvil 35 of the bit shank 32. The lower part 36 of the bit shank is splined for slidable, but non-rotatable movement, in a correspondingly grooved bore of the driver sub 33.

A sliding seal tube 37 has its lower end fixed in the top of an air passage 38 which is formed axially through the bit shank 32 and communicates with several air ducts 39 through the bit and leading into flutes 40 down the sides of the bit. Ducts 41, lead obliquely upwards and outwards through a collar 42 about the lower end of the driver sub 33 and which is of greater diameter meter than the tubular casing 10. The ducts 41 alternate with small cutter teeth 42*a* about the top periphery of the collar 42.

The air outflow tube 21 extends co-axially down through the air passage 38 of the bit shank and has its lower end closely but slidably engaged in an axial passage 43 in the bit, this passage 43 leading by way of several oblique air ducts 44 to the bottom of the bit.

Figure 2:
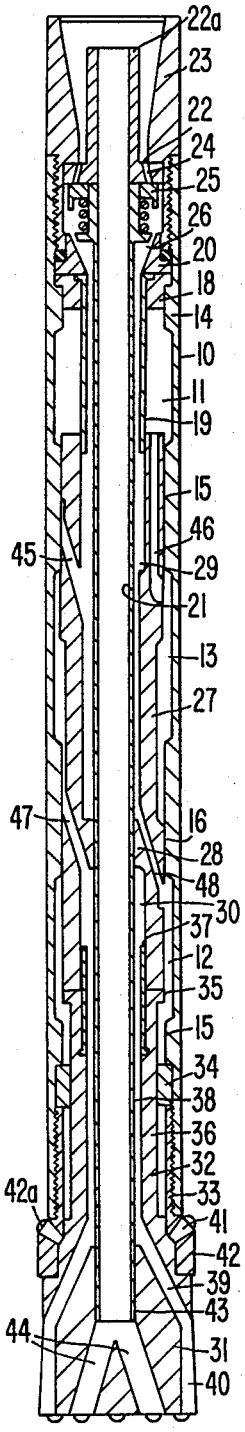
FIG. 2 shows in section the hammer with its piston driven down anvil; into the and FIG. 3 is a similar view of the hammer lifted from the work face.

Assuming the piston 27 is initially raised, as shown in FIG. 1, its upper end close to the piston stop ring 18, then air under pressure passing through the feed tube 19 enters the upper axial passage 29 of the piston and thence passes through an oblique pressure port 45 into the top pressure chamber 11 to drive the piston down into the anvil 35, as shown in FIG. 2, driving the bit 31 on the work face.

Air under pressure in the top pressure chamber 11 can then pass into the central chamber 13 by way of a top exhaust port 46 in the piston, this port being closed when the piston is rised to its previous position shown in FIG. 1.

From the central chamber 13 the air under pressure can pas through a central chamber exhaust port 47 in the piston to the piston's lower axial passage 30, through the sliding seal tube 37 and the axial passage 38 of the bit shank, and through the air ducts 39 and flutes 40. Rock fragments are carried by the air flow into the bit by way of the air ducts 44, and thence up through the air outflow tube 21.

When the piston 27 has been brought down on the anvil 35, as described, air under pressure in the upper axial passage 29 of the piston is conducted through a pressure port 48 in the piston to the bottom pressure chamber 12 to drive the piston upwards, the port 48 being quickly closed on entering the lower piston bearing 17. When the piston rises clear of the sliding seal tube 37, air under pressure in the bottom pressure chamber 12 can expand into the lower axial passage 30 of the piston and thence through the oblique port 47 to the central chamber 13. With the up-stroke of the piston, air is compressed between it and the piston stop ring 18 to absorb shock an give reaction air thrust before the pressure port 45 is opened to cause the piston to be driven down again.

It will be seen that while the hammer is in operation, the rock fragments produced are carried up through the hammer in a strong up-flow of air, and are brought up to ground level through the double tube drill stem without contamination from higher levels of the hole drilled.

Figure 3:
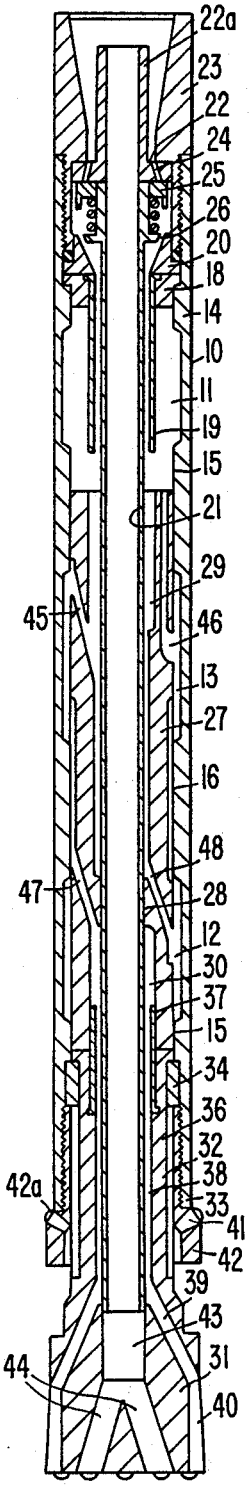

As soon as the casing 10 is lifted to bring the bit 31 clear of the work face, the bit drops relative to the casing, as shown in FIG. 3, until the anvil 35 rests on the anvil stop ring 34, the piston 27 coming to rest on the anvil. The hammer is then in a condition of air balance; but as soon as the casing is lowered to bring the bit onto the work face, the hammer will immediately recommence operation.

In the event of the hammer being being blocked in the hole, air may be introduced under pressure through the central tubular part 22*a* of the air inlet fitting 22, to be expelled through the air ducts 44, up through the bit flutes 40 and through the passages 41 of the collar 42, to blow obstructing material up through the hole. If necessary, obstructing material may be cut through by rotating and lifting the hammer so that the cutters 42*a* will break up the blockage.

I claim;

1. A pneumatic percussion hammer for rock drilling including:

a tubular casing;

a top sub at the top of the casing for connection to, and to receive air under pressure from, the outer tube of a double tube drill stem;

an air feed pipe from the top sub extending co-axially into the casing;

an air outflow pipe for connection at the top to the inner tube of the drill stem and passing co-axially through the air feed pipe;

a bit, its shank mounted for limited sliable movement in the lower end of the casing;

an anvil on the btt shank;

a bit air passage through the anvil, shank and bit, slidably engaged on the lower end of the air outflow pipe and ducted to the exterior of the bit, the lower end of the air outflow pipe being slidably engaged in the lower part of the bit air passage and communicating through ducts to the bottom of the bit;

a sliding seal tube extending up from the upper part of the bit air passage and disposed co-axially about the air outflow pipe;

a piston disposed co-axially about the air outflow tube and slidable in the casing to strike the anvil on its down-stroke, the bore of the piston being restricted at an intermediate position for close slidable engagement with the air outflow tube and to divide the axial passage of the piston into an upper axial passage which is slidably engaged with the air feed tube and a lower axial passage for slidable engagement, when the piston is on its down-stroke, with the sliding seal tube;

a top pressure chamber in the casing about and above the top of the piston;

a bottom pressure chamber in the casing about and below the piston;

a central chamber in the casing about an intermediate part of the piston;

pressure ports in the piston for directing air under pressure from the upper axial passage of the piston to the top pressure chamber when the piston is in raised position and to the bottom pressure chamber when the piston is in lowered position; and exhaust ports in the piston for conducing air, when the piston is lowered, from the central chamber to the top pressure chamber.

2. A pneumatic percussion hamer according to claim 1 wherein:

the piston, on descending to the anvil, when the bit is lifted clear of a work face, and the anvil is brought below normal operating position, brings the hammer to a condition of air balance, automatically discontinuing its operation.

3. A pneumatic percussion hammer according to claim 1 wherein:

the bit shank is splined for limited slidable movement in a drive sub at the lower end of the casing; and the drive sub, below the casing, is of greater diameter than the casing and provided with cutters for the purpose hereinbefore set out.

* * * * *